United States Patent [19]

Phillips et al.

[11] Patent Number: 5,039,451

[45] Date of Patent: Aug. 13, 1991

[54] MANUFACTURING CONCENTRATED SURFACTANT COMPOSITIONS

[75] Inventors: Brinley M. Phillips; Brian J. Akred, both of Whitehaven, England

[73] Assignee: Albright & Wilson Limited, Warley, England

[21] Appl. No.: 267,622

[22] Filed: Nov. 2, 1988

Related U.S. Application Data

[63] Continuation of Ser. No. 9,112, Jan. 29, 1987, abandoned, which is a continuation of Ser. No. 713,087, Mar. 18, 1985, abandoned, which is a continuation of Ser. No. 593,184, Mar. 26, 1984, abandoned, which is a continuation of Ser. No. 967,579, Dec. 8, 1978, abandoned.

[30] Foreign Application Priority Data

May 26, 1978 [GB] United Kingdom ..... 22992/78

[51] Int. Cl.[5] ..... B01F 17/18; B01F 17/28; B01F 17/32

[52] U.S. Cl. ..... 252/356; 252/314; 252/354; 252/357; 252/542; 252/546; 252/547; 252/DIG. 7; 252/DIG. 14

[58] Field of Search ..... 252/356, 546, 547, DIG. 7, 252/DIG. 14, 357

[56] References Cited

U.S. PATENT DOCUMENTS

| | | | |
|---|---|---|---|
| 3,876,563 | 4/1975 | Collins | 252/546 X |
| 3,892,669 | 7/1975 | Rapisarda et al. | 252/547 X |
| 3,941,817 | 3/1976 | Chakrabarti | 252/356 X |
| 4,243,549 | 1/1981 | Messenger et al. | 252/546 X |

FOREIGN PATENT DOCUMENTS

| | | | |
|---|---|---|---|
| 907457 | 8/1972 | Canada | 252/547 |

OTHER PUBLICATIONS

Rogers et al., "The Nature of the Striated Textures Encountered with . . . Liquid Crystalline Phases", *J. Colloid & Interface Science,* vol. 30, No. 4, Aug. 1969, pp. 500–510.

Mausner et al.: "Hydrotropes in Liquid Syndets", *Soap & Chemical Specialties,* vol. 38, No. 2, Feb. 1962, p. 47.

*Primary Examiner*—Richard D. Lovering

*Attorney, Agent, or Firm*—Frishauf, Holtz, Goodman & Woodward

[57] ABSTRACT

Mixtures of surfactants capable of forming "G" phase are prepared by forming one component of the mixture from a precursor in the presence of the other component or components and sufficient water form the product in the "G" phase.

14 Claims, No Drawings

MANUFACTURING CONCENTRATED SURFACTANT COMPOSITIONS

This application is a continuation of Ser. No. 009,112 filed Jan. 29, 1987 (abandoned); which is a continuation of Ser. No. 713,087 filed Mar. 18, 1985 (abandoned); which is a continuation of Ser. No. 593,184 filed Mar. 26, 1984 (abandoned); which is a continuation of Ser. No. 967,579 filed Dec. 8, 1978 (abandoned).

This invention relates to a method for the preparation of concentrated surfactant mixtures.

Mixtures of surfactants are prepared and sold for a wide Variety of industrial and domestic applications They are often required in a fluid form, and it desirable that they should contain as high a proportion of active material as possible, in order to reduce the costs of storage and transport.

Where the mixture has a melting point below, or only slightly above ambient temperature it is sometimes possible to supply the composition in the form of an anhydrous mixture, or a mixture containing up to about 5% of water, respectively. In the latter case the trace of water appears to act as a melting point depressor.

However, in the case of surfactant mixtures which are solid at temperatures above about 25° C., it has often been impossible to obtain a fluid composition at concentrations above about 30% to 50% by weight of active ingredient, depending on the nature of the mixture. Small amounts of water up to about 10% do not depress the melting point sufficiently, while larger amounts, sufficient to cause a phase change result in the formation of a rigid gel, rather than a fluid solution. It has generally been found that as the total concentration of active ingredient in a dilute solution approaches a critical level, which is usually about 30% by weight but may in the case of some mixtures be higher, e.g. up to about 55% by weight, the viscosity of the solution begins to rise, causing difficulty in preparing and handling the solution. At the critical level the solution sets into an immobile gel or phase separation occurs.

It is sometimes possible to increase the concentration of active ingredient by addition of viscosity modifiers or cosolvents, such as alcohols, which act as thinners, both lowering the viscosity of the solution and inhibiting the formation of gels, so that higher concentrations may be attained Such cosolvents are normally only effective in producing substantial increases in the attainable concentration when they are present in such large amounts that they may constitute a fire hazard, adversely affect the properties of the product for many of its desired end uses and/or increase the cost of the product The term "active concentration" as used herein means the total concentration of "active", i.e. surface active, material in the aqueous composition.

It has been reported (see for example "Advances in Colloid Interface Science" (1967) 79-110 pp. 82-83) that some surfactant compounds are capable of forming highly viscous, non-pumpable liquid crystal phases. Some of these compounds form a- phase of relatively low viscosity compared with the other liquid crystal phases, which is usually referred to as the "G" or "lamellar phase" and which forms only within a specific concentration range. However, in most instances, including the case of virtually all those compounds which are of industrial interest, where the existence of a "G" phase has been reported, it can only be formed at elevated temperature. Thus, for example, sodium lauryl sulphate has been reported to form a phase, at about 74° C. which is pourable. However, due to the elevated temperature required at which the sodium lauryl sulphate is hydrolytically unstable, this phenomenon has hitherto been regarded as having purely academic interest. There has been no recognized industrial application of this phenomenon. Moreover, it has never been reported that mixtures of different kinds of surfactant are capable of forming a "G" phase.

Recently, we have discovered that certain surfactants of commercial value including some ammonium alkyl sulphates and some olefin sulphonates form "G" phases at ambient temperature. As a consequence of this discovery we are now able to prepare these surfactants in a fluid form at very much higher concentrations than could previously have been achieved. (See for example our copending British Patent Applications Nos.2038/74 and 1745/75).

We have now discovered that many mixtures of surfactants form a fluid lamellar (G) phase within a narrow range of concentrations lying above the concentration at which the immobile phase forms. This range often lies above 60% active concentration and may be as high as 80%; it may only extend over a very narrow concentration range of within ±2% to 5% of the viscosity minimum.

The mixtures frequently form fluid "G" phases at relatively low temperatures compared with the typical minimum temperatures at which aqueous solutions of most individual surfactants which are capable of forming "G" phases can exist in such a phase, and in many instances form "G" phases from components some or all of which cannot be readily be obtained in a "G" phase themselves.

In such cases the preparation of a "G" phase presents particular problems, since the normal method of making surfactant mixtures is to prepare the separate components at respective concentrations such that when mixed together they provide a mixture having the desired activity. When there is difficulty in obtaining one or more components at the required concentration in sufficiently fluid form to be handled by normal commercial mixing apparatus, the only alternative is to mix more dilute solutions of the components and evaporate water from the mixture.

This procedure is not generally economically practicable on a commercial scale.

We have now discovered that a mixture of different surfactants which can exist in the "G" phase, can most readily be obtained in the "G" phase by forming one surfactant component of the mixture in the presence of the other surfactant component or components and in the presence of the appropriate amount of water.

Our invention provides a method for the manufacture of concentrated aqueous surface active compositions, comprising as the active constituent a mixture of at least two different non-homologous surfactants which is capable for forming a fluid "G" phase, wherein at least one of the surfactants is capable of being formed in aqueous solution from a liquid precursor by a reagent which does not cause substantial degradation of the other surfactant or surfactants, and wherein the composition is formed by converting at least one of the precursors into the corresponding surfactant, in the presence of the other surfactant or surfactants, while maintaining sufficient water in the mixture to maintain the composition in a pourable state and form a pourable product which is at least predominantly in the "G" phase.

The "G" phase is a pumpable fluid which is formed over a narrow range of concentrations which range usually lies somewhere between 45% and 80% by weight of active ingredient and is characterized by a lamellar structure in which the surfactant molecules are associated to form plates of indefinite size separated by planes of water molecules.

Typically when a surfactant mixture is prepared in aqueous solutions of increasing concentration, the molecules are first found to associate in spherical clusters (micelles), which with increasing concentration become rod-like. At higher concentrations the micelles become more crowded causing a rise in the viscosity of the solution and, in the great majority of cases, eventually lengthen to form a regular hexagonal array of cylindrical surfactant micelles in an aqueous medium (the rigid "$M_1$" liquid crystal phase) If the concentration of a surfactant in the "$M_1$" phase is progressively increased a phase change occurs to give either a hydrated solid phase, or, in the case of surfactant mixtures of this invention, to convert the $M_1$ phase progressively to a fluid "G" phase until a viscosity minimum is reached. Further increase in the concentration of the "G" phase causes the viscosity to rise until a further phase change occurs. This may lead to the formation of either a hydrated solid or a second immobile liquid crystal phase (the $M_2$ phase) which resembles the $M_1$ phase in structure, but inverted—i.e. with water as the internal phase and the surfactant as the continuous phase.

The foregoing description is somewhat simplified. The term "hydrated solid phase" has been used broadly to include those systems which comprise suspensions of solid or immobile gel phases in one or more viscous or gel phase to provide a more or less rigid material usually having a granular appearance under a polarizing microscope. No one surfactant has been found which will form all the various liquid crystal phases.

In general, we have found, to a good approximation, that the proportion of active mixture required for form a "G" phase can be determined from the formula:

$$\frac{C_1}{g_1} + \frac{C_2}{g_2} + \ldots \frac{C_n}{g_n} = 1, \text{ where}$$

$C_1 \ldots C_n$ are the concentrations of the individual active components and $g_1 \ldots g_n$ are the concentrations at which each component forms a "G" phase of minimum viscosity. This formula enables the concentration of the mixture corresponding to the minimum viscosity "G" phase to be estimated in a majority of cases. Where g is not known, or a component does not form a "G" phase, or the above formula is not applicable, then any "G" phase can be located very rapidly and easily, using standard laboratory equipment by making a test composition having an active concentration of say 75% (or, where appropriate, whatever concentration has been estimated on the basis of the foregoing formula) and placing a sample on a slide on the block of a heated stage microscope. Examination between crossed polarizers will reveal in which phase the sample is present. The various phases each have a characteristic appearance which is easily identified by comparison for example with the photographs of typical liquid crystal phases in the classic paper by Rosevear, JAOCS Vol.31 P.628 (1954) or in J. Colloid and Interfacial Science, Vol.30 No. 4.P.500.

If the mixture is in an $M_1$ phase, water may be allowed to evaporate from the edges of the sample under the cover disk and any phase changes observed. If any $M_2$ phase or hydrated solid is present water may be added around the edge of the cover disks and allowed to diffuse into the composition. If no "G" phase is located in this way samples may be heated progressively on the block and the operations repeated.

Usually the composition is pumpable at concentrations within a range of ±10%, preferably ±5% e.g. ±2.5% of the minimum viscosity concentration. This range tends to be broader at more elevated temperatures. Compositions may be obtained, at the limits of the range in which open or more solid or gel phase is suspended in a continuous "G" phase. Such compositions are often useful on account of their appearance.

Typically the compositions prepared according to the invention contain two, three or four different kinds of surfactant each in a concentration of more than 10% by weight of the composition.

The compositions prepared according to our invention may contain minor amounts of non-surfactant organic solvents, such as glycols or fatty alcohols, and of non-colloidal electrolytes such as sodium chloride, or sulphate. Such inclusions are often present as impurities in the surfactants However we prefer not to add appreciable amounts of solvents to the compositions prepared according to our invention We prefer where possible to maintain the proportion of non-surfactant organic solvent below 5% by weight total composition and preferably below 5% by weight of the active mixture. Most preferably the proportion is less than 2% by weight of the total composition e.g. less than 1%. The presence of inorganic salts or similar non-colloidal electrolytes does not generally have the same substantial disadvantages as the presence of organic solvents, but it is nevertheless generally undesirable because it tends to raise the viscosity of the fluid "G" phase and in the case of chloride, may cause corrosion problems We, therefore, prefer, generally that the proportion of non-surface active electrolyte be maintained within the same limits as those stated in relation to organic solvents. However, there are certain circumstances in which the presence of some electrolyte may be useful, e.g. when the melting point of the "G" phase is slightly above ambient, and an increase in the electrolyte content may depress the melting point sufficiently to obtain a pumpable "G" phase without heating. In such circumstances it may sometimes be desirable deliberately to add up to about 6% by weight of electrolyte, usually sodium chloride, or sodium sulphate.

Our invention may be used to prepare mixtures of anionic surfactants with other non-homologous anionic surfactants and/or with nonionic and/or amphoteric surfactants, or of cationic surfactants with other non-homologous cationic surfactants and/or with nonionic and/or amphoteric surfactants. It is also possible according to our invention to mix amphoteric surfactants with other non-homologous amphoteric surfactants and/or nonionic surfactants. Generally, we prefer not to prepare mixtures containing both cationic and anionic surfactants. It is possible to prepare some mixtures of nonionic surfactants according to our invention although in most cases the invention is less advantageous when applied to such mixtures.

Anionic surfactants are generally prepared, in accordance with the present invention, by the neutralization of an acid precursor such as an organic sulphuric, sulphonic, carboxylic or phosphoric acid, using a base capable of forming a water soluble salt of the acid. The most commonly used bases for the neutralization are sodium, potassium or ammonium hydroxide or carbonate. Organic bases including lower amines containing up to six aliphatic carbon atoms, especially mono-, di- or triethanolamine, may also be used.

Typical examples of surfactants which may be prepared in accordance with our invention from acid precursors by neutralization as aforesaid include: alkyl sulphates, alkyl phenol sulphates, alkyl ether sulphates, alkyl phenyl ether sulphates, alkyl amido ether sulphates or alkyl amine ether sulphates from the corresponding organic sulphuric acids; olefin sulphonates, paraffin sulphonates, alkyl phenyl ether sulphonates, fatty ester sulphonates, fatty acid sulphonates, or alkyl benzene sulphonates from the corresponding sulphonic acids; alkyl phosphates or alkyl ether phosphates from the corresponding organic phosphoric acids; and alkyl carboxylates or alkyl ether carboxylates from the corresponding carboxylic acids;

Another reaction which may be used, in the preparation of anionic surfactants from their precursors according to invention, is reaction of a sulphite such as sodium sulphite with a precursor such as a half ester of maleic acid. This latter method may be used for example to prepare sulpho acetates, alkyl sulphosuccinates, alkyl ether sulphosuccinates, alkanolamide sulphosuccinates, alkanolamido ether sulphosuccinates, alkyl sulphosuccinamates and alkyl ether sulphosuccinamates. Other categories of anionic surfactant include IGEPONS which are prepared by reacting the appropriate precursors with chloracetic acid.

Each of the aforesaid anionic surfactants have alkyl or alkenyl groups which normally contain an average of between 8 and 22 carbon atoms, preferably 10 to 22 e.g. 12 to 18. The term "ether" as applied herein to surfactants means glyceryl ethers, and/or polyoxyalkylene ethers containing from 1 to 30, preferably up to 10 oxyethylene and/or oxypropylene groups.

Any cationic surfactant present or prepared in the method of our invention may for example be an alkylammonium salt having a total of at least 8, usually 10 to 30 e.g. 12 to 24 aliphatic carbon atoms, especially a tri or tetra-alkyl-ammonium salt. Typically alkylammonium surfactants for use according to our invention have one or at most two relatively long aliphatic chains per molecule (e.g. chains having an average of 8 to 20 carbon atoms each, usually 12 to 18 carbon atoms) and two or three relatively short chain alkyl or aralkyl groups having 1 to 4 aliphatic carbon atoms each, e.g. benzyl, methyl, butyl or ethyl groups, preferably methyl groups. Typical examples include dodecyl trimethyl ammonium salts or cetyl dimethyl benzyl ammonium salts. Typically the cationic surfactant is prepared by reacting an amine precursor with a quaternising agent such as an alkyl chloride or sulphate or with an acid.

Another class of cationic surfactants useful according to our invention are N-alkyl pyridinium salts wherein the alkyl group has an average of from 8 to 22 preferably 10 to 20 carbon atoms. Other similarly alkylated heterocyclic salts, such as N-alkyl isoquinolinium salts, may also be used. For example N-methyl dodecyl pyridinium chloride may be obtained from a dodecyl pyridine precursor and a methyl chloride quaternising reagent.

Alkylaryl tri- or preferably dialkylammonium salts, having an average of from 10 to 30 aliphatic carbon atoms are useful, e.g. those in which the alkylaryl group is an alkyl benzene group having an average of from 8 to 22, preferably 10 to 20 aliphatic carbon atoms and the other alkyl groups usually have from 1 to 4 carbon atoms e.g. methyl groups.

Other classes of cationic surfactant which are of use in our invention include alkyl imidazoline or quaternized imidazoline salts having at least one alkyl group in the molecule with an average of from 8 to 22 preferably 10 to 20 carbon atoms. Typical examples include alkyl methyl hydroxyethyl imidazolinium salts, alkyl benzyl hydroxyethyl imidazolinium salts, and 2 alkyl- 1-alkylamidoethyl imidazoline salts. Another class of cationic surfactant for use according to our invention comprises salts of the amido amines such as those formed by reacting a fatty acid having8 to 22 carbon atoms or an ester, glyceride or similar amide forming derivative thereof, with a di- or poly-amine, such as, for example, ethylene diamine or diethylene triamine, in such proportion as to leave at least one free amine group. Quaternized amido amines may similarly be employed.

Typically the cationic surfactant may be any water soluble compound having a positively ionized group, usually comprising a nitrogen atom, and either one or two alkyl groups each having an average of from 8 to 22 carbon atoms.

The anionic portion of the cationic surfactant may be any anion which confers water solubility, such as formate, acetate, lactate, tartarate, citrate, hydrochloride, nitrate, sulphate or an alkylsulphate ion having up to 4 carbon atoms such as methosulphate. It is preferably not a surface active anion such as a higher sulphate or organic sulphonate.

The active mixtures prepared according to our invention may comprise one or more amphoteric surfactant. The amphoteric surfactant may for example be a betaine, e.g. a betaine of the formula:

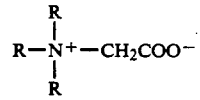

wherein each R is an alkyl, cycioalkyl, alkenyl or alkaryl group and preferably at least one and most preferably not more than one R has an average of from 8 to 20 e.g. 10 to 18 aliphatic carbon atoms and each other R has an average of from 1 to 4 carbon atoms. Particularly preferred are the so called quaternary imidazoline betaines commonly ascribed the formula:e

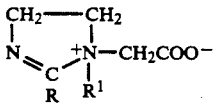

wherein R and $R^1$ are alkyl, alkenyl, cycloalkyl, alkaryl or alkanol groups having an average of from 1 to 20 aliphatic carbon atoms and R preferably has an average of from 8 to 20 e.g. 10 to 18 aliphatic carbon atoms and $R^1$ preferably has 1 to 4 carbon atoms. Other amphoteric surfactants for use according to our invention include alkyl amine ether sulphates, sulphobetaines and other quaternary amine or quaternized imidazoline carboxylic acids and their salts and Zwitterionic surfactants, and amino acids, having, in each case hydrocarbon groups capable of conferring surfactant properties (e.g. alkyl, cycloalkyl, alkenyl or alkaryl groups having from 8 to 20 aliphatic carbon atoms). Typical examples include $C_{12}H_{25}N(+CH_3)_2CH_2COO^-$. Generally speaking, any water soluble amphoteric or Zwitterionic surfactant compound which comprises a hydrophobic portion including a $C_{8-20}$ alkyl or alkenyl group and a hydrophilic portion containing an amine or quaternary ammonium group and a carboxylate, sulphate or sulphonic acid group may be used in our invention.

The amphoteric surfactant is usually prepared by reacting an amine, or nitrogen containing heterocyclic precursor with chloracetic acid.

The mixtures may additionally contain at least one nonionic surfactant. The nonionic surfactant is typically a polyalkoxylated fatty alcohol, fatty acid, alkyl phenol, glyceryl ester, sorbitan ester or alkanolamine, wherein in each case there is an alkyl group containing an average of from 8 to 22 preferably 10 to 20, carbon atoms and a polyalkylene oxy group, usually containing an average of from 1 to 20, e.g. 3 to 10 alkylene oxy units. The alkyleneoxy units are normally ethylenoxy units, but the group may also contain some propyleneoxy units.

The alkoxylated nonionic surfactants are usually prepared by reacting the precursor alcohol, alkyl phenol, acid, ester or alkylolamide with ethylene oxide and/or propylene oxide. In such cases it is not usually practicable to perform the alkoxylation in aqueous solution, and the aforesaid nonionic surfactants will, therefore, normally be part of the preformed component of the final product mixture. The alkyl and alkoxylated alkyl amine oxides having at least one alkyl group with an average of from 8 to 22 carbon atoms are also included among the nonionic surfactants which are suitable for use in our invention.

The amine oxides are usually prepared by reacting the corresponding amine precursor with an oxidizing agent, such as hydrogen peroxide, in aqueous solution.

It will be understood that the various surfactants referred to herein will each, in practice, normally be mixtures of close homologs so that the figures quoted for the size of the alkyl or polyoxyalkylene groups are in each case averages. Homologs in the present context means molecules differing only in respect of the number of carbon atoms in their respective alkyl groups, and/or the number of alkyleneoxy or other repeating monomer units in a polyalkyleneoxy or similar polymeric chain.

The foregoing list of surfactants is by no means comprehensive and is intended to be merely exemplary of the very wide range of surfactants that can be included in mixtures prepared according to our invention. A more comprehensive list of surfactants and methods for preparing them from their precursors will be found in "Surface Active Agents and Detergents" by Schwartz, Perry and Berch or in "Surfactant Science Series" published in New York by Decca.

In preparing mixtures of surfactants according to our invention it is first necessary to select a surfactant component of the mixture which is capable of being formed from a liquid precursor in aqueous solution in the presence of the other surfactants without causing substantial degradation of the latter. Where more than one surfactant in the desired mixture is suitable, the precursor of the surfactant which is most difficult to obtain in a "G" phase is often the most convenient to choose.

The preparation may be carried out by mixing the precursor and the other surfactant or surfactants, in an anhydrous state, where these form a liquid mixture, and adding an aqueous reagent to convert the precursor into the corresponding surfactant and form the aqueous composition. Alternatively, when the other surfactant or surfactants can be obtained at an appropriate concentration, e.g. in a fluid "G" phase, an aqueous solution thereof may be used to which may be added the anhydrous reagent, simultaneously, or in any convenient order, to avoid gel formation. Where the precursor is only sparingly water soluble, or can be obtained at an appropriate concentration without giving rise to problems of gel formation, then it may be introduced into the system at any convenient stage as an aqueous system. In some cases, the precursor may be emulsified in the reaction mixture. Often it is convenient to prepare a multicomponent mixture in stages, each stage in accordance with the invention.

The invention reduces difficulties which often arise in blending high active mixtures where a component of the mixture cannot be obtained in sufficiently highly concentrated form due to problems of gel formation.

The invention is illustrated by the following examples:

EXAMPLE 1

It was desired to prepare a 1 : 1 mixture of betaine (tallow/ coconut amido propyl (dimethyl) aminoacetate, $RCONHCH_2CH_2CH_2(CH_3)_2{+}NCH_2COO$, (hereinafter called BT) with lauric diethanolamide $RCON(CH_2CH_2OH)_2$, hereinafter referred to as LD. BT is normally prepared by reacting the amido amine precursor $RCONHCH_2CH_2CH_2N(CH_3)_2$, hereinafter called AT, with sodium chloracetate in aqueous solution.

$$RCONHCH_2CH_2CH_2N(CH_3)_2 + Cl\,CH_2COONa \rightarrow RCONH(CH_3)_3N(CH_3)_2CH_2COO$$

Typically BT is prepared and sold at about 30% by weight concentration. The maximum concentration at which BT can be prepared in water as a pumpable solution is about 35% by weight.

LD is normally available commercially at about 90% active concentration, together with methyl esters, amines and ester amines as impurities.

Equimolar amounts of the commercially available products blended provide a maximum possible active concentration of 50%. However, we have discovered, by evaporating down a 50% mixture, that a pourable "G" phase can be obtained at active concentrations of 60 to 65% by weight. To prepare such a composition by blending would require a 45 to 50% by weight aqueous solution of BT, which is an intractable, immobile gel.

A

A 1 liter, jacketed reaction vessel with stirring and recycle facilities was charged with 335g AT (91%, 1 mol) and 400g LD (90%). The mixture was warmed to 65° C. and a solution of 104 g chloroacetic acid (1.1 m) in 284 g water was added over 2½ hours maintaining the pH at 7.5±0.5, by the addition of 47% sodium hydroxide solution. The reaction was continued for a further 12 hours at pH 7.5±0.5, at 65° C. when the free amido amine was found to be 0.9%. The product was a mobile "G" phase, having a total active concentration of 60%.

B

A 10 liter jacketed reactor with stirring and recycle facilities was charged with a solution of 808 g chloracetic acid in 1831 g water. A mixture of 2774 g LD (90%) and 2359 g of glycerol-free AT (89% amido amine) was then charged with stirring. The resulting mobile mixture was heated to 65° C. and recycled to improve mixing. The pH was raised to, and maintained at, 7.5–8.0 by the addition of 47% sodium hydroxide solution, and the temperature was maintained at 65° C. After 17 hour reaction the free amido amine was found to be 1.5%. The final product was a mobile "G" phase having a total active concentration of 60%.

Composition of formulation

Botn the BT and LD contained some impurities, and the approximate composition of the formulation prepared according to Example 1A is given below:

Amido Amine betaine: 30%
Lauric Diethanolamide: 30%
Amine esters etc.: 3%
Glycerol: 3%
Amido amine: 1%–2%
NaCl: 5%–6%
$H_2O$:27%

In example 1B the AT had been washed to remove the glycerol, and in the final product the glycerol was replaced by water.

EXAMPLE 2

A stirred, jacketed flask, equipped with a means of recycling material from the bottom to the top of the flask to assist mixing, was charged with 797 g of a 70% solution of a $C_{12}$/C alkyl sodium 2 mole ethoxylated sulphate. The solution, which was in the G phase was heated to 60° C., and 442 g of a $C_{12/14}$ alkyl dimethylamine (molecular weight =221) was added over 30 mins. together with a solution of 209 g chloracetic acid dissolved in 140 g water, maintaining the pH at 7.8±0.2 by the addition of 47% sodium hydroxide solution. The pH was then raised to 8.5, and the temperature was raised to 65° C., and the reaction was maintained under these conditions for a further 6 hours when it was no longer necessary to add sodium hydroxide to maintain a constant pH, indicating that quaternization was substantially complete. This was verified by analysis, showing that the sample contained 0.2% unreacted amine. Approximately 203 g of 47% sodium hydroxide was required in this preparation.

In this example a betaine was prepared in the presence of an ethoxylated sulphate. The product had a total surfactant concentration of 63%, in a weight ratio of 1 : 1 amphoteric: anionic surfactant and was a fluid material identified as G phase throughout the reaction. To prepare this blend by mixing a solution of the betaine with 70% solution of the ethoxylated sulphate would require a betaine concentration of 57%, and at this concentration the material is a highly viscous gel, in the $M_1$ phase.

EXAMPLE 3

A stirred jacketed flask, equipped with a means of recycling material from the bottom to the top of the flask to assist mixing was charged with 778 g of a $C_{13}/C_{14}$ alkyl sodium 2 mole ethoxylated sulphate. The solution which was in the G phase was heated to 60° C., and 458 g of an amido amine of the formula

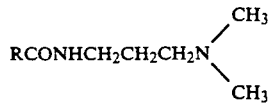

(R = 75% coconut + 25% tallow, MMW = 305)

was added over 45 mins. together with a solution of 149 g chloroacetic acid in 135 g water.

the pH was then raised to 8.5 by the addition of 47% sodium hydroxide solution, and the temperature was raised to 65° C. The reaction was maintained under these conditions for a further 9 hrs. until it was no longer necessary to add sodium hydroxide to maintain a constant pH, indicating that quaternization was substantially complete. Approximately 142 g of 47% sodium hydroxide solution was required in this preparation.

In this example an amido amine betaine was prepared in the presence of an ethoxylated sulphate, and the blend had a total surfactant concentration of 66% in a weight ratio of 1:1 anionic:amphoteric surfactant. The material was a mobile liquid, identified as G phase, throughout the reaction. To prepare this blend by mixing a solution of the amido amine betaine with the 70% solution of the ethoxylated sulphate would require an amido amine betaine concentration of 62%, and at this concentration the material is a highly viscous gel identified as $M_1$ phase.

EXAMPLE 4

A stirred jacketed flask, equipped with a means of recycling material from the bottom to the top of the flask, was charged with 588 g of 90% pure lauric diethanolamide. The lauric diethanolamide was heated to 60° C., and 442 g of a $C_{12/14}$ alkyl dimethylamine having a molecular weight of 221 was added over a 20 min. period together with sufficient quantity of a solution of 208 g chloracetic acid in 290 g water to maintain the pH in the range 7–8. The remainder of the chloracetic acid solution was then added maintaining the pH in the range 7–8 by the addition of 47% sodium hydroxide solution.

The pH of the mixture was raised to 8.5, and the temperature was increased to 65° C., and the reaction was maintained under these conditions for a further 9 hrs., when no further sodium hydroxide solution was required to maintain a constant pH, indicating that quaternization was substantially completed. Approximately 216 g of 47% sodium hydroxide solution was required in this preparation.

In this example a betaine was prepared in the presence of lauric diethanolamide, and the blend had a total surfactant concentration of 66% in a weight ratio of 1:1 amphoteric:nonionic surfactant and was a mobile liquid identified as G phase throughout the reaction.

To prepare this blend by mixing a solution of the betaine with the lauric diethanolamide would require a betaine concentration of 44% and at this concentration the material is a highly viscous gel in the $M_1$ phase.

EXAMPLE 5

A stirred jacketed flask, equipped with a means of recycling material from the bottom to the top of the flask was charged with 472 g of a 72% solution of a $C_{12/14}$ amine oxide, derived from an ethoxylated alcohol. The amine oxide is represented by the formula

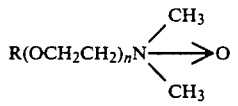

where the average value of n =3.

The solution which was in the G phase was heated to 50° C. and 276 g of a $C_{12}/_{14}$ alkyl dimethylamine (molecular weight =221) was added together with a sufficient quantity of a solution of 124.8 g chloroacetic acid in 19.8 g water at 60° C. to maintain the pH in the range 8.5–9.0. The remainder of the chloroacetic acid solution was then added maintaining the pH in the range 8.5–9.0 by the addition of 57% sodium hydroxide solution to maintain a constant pH, indicating that quaternization was substantially complete. Approximately 92.5 g of 57% sodium hydroxide solution was required in this preparation.

In this example a betaine was prepared in the presence of an amine oxide, and the blend had a total surfactant concentration of 69% in a weight ratio of 1:1 nonionic:amphoteric surfactant, and the material was a mobile liquid identified as G phase, throughout the reaction. To prepare this blend by mixing a solution of the betaine with the 72% amine oxide would require a betaine concentration of 67%, and at this concentration the material is a highly viscous gel in the $M_1$ phase.

EXAMPLE 6

A stirred jacketed flask, equipped with a means of recycling material from the bottom to the top of the flask to assist mixing was charged with 500 g of a 90% solution of a $C_{12}/_{14}$ alkyl benzyl ammonium chloride. The surfactant solution which was a clear mobile liquid in the $L_2$ phase was heated to 55° C., and 377 g of an amido amine of the formula

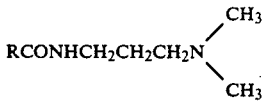

(R = 75% coconut + 25% tallow, MMW = 305)

was charged over 45 mins., together with sufficient quantity of a solution of 122.7 g chloracetic acid in 90 g water to maintain the pH in the range 7–8. The remaining chloroacetic acid was then added, and the pH was raised to 8 by the addition or 47% sodium hydroxide solution. The temperature was raised to 65° C., and the pH was maintained in the range 8–8.5 for a further 10 hrs., when it was no longer necessary to add sodium hydroxide to maintain a constant pH indicating that quaternization was substantially complete. Approximately 110.6 g of 47% hydroxide solution was required.

In this example an amido amine betaine was prepared in the presence of a cationic surfactant and the blend had a total surfactant concentration of 75% in a weight ratio of 1.1 amphoteric:cationic surfactant. During the addition of the amido amine and chloracetic acid solution the material formed a G phase, and remained in this phase throughout the reaction.

To prepare this blend by mixing a solution of the betaine and the 90% benzyl ammonium chloride derivative would require a betaine concentration of 64%, and at this concentration the material is a rigid gel in the $M_1$ phase.

EXAMPLE 7

A stirred jacketed flask, equipped with a means of recycling material from the bottom to the top of the flask was charged with 473.7 of 90% pure coconut diethanolamide. The material was heated to 60° C. and 377 g of an amido amine of the formula

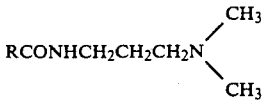

(R = 75% coconut + 25% tallow, MMW = 305)

was added. A solution of 122.7 g chloracetic acid in 200 g water was then added, maintaining the pH in the range 8–8.5 by the addition of 47% sodium hydroxide solution. The temperature was then raised to 65° C. and the pH maintained in the range 8–8.5 for a further 8 hrs., when it was found that no further sodium hydroxide solution was required to maintain a constant pH, indicating that quaternization was complete. Approximately 101 g 47% sodium hydroxide solution was required in this preparation.

In this example an amido amine betaine was prepared in the presence of coconut diethanolamide, and the blend had a total surfactant concentration of 69% in a weight ratio of 1_1 amphoteric:nonionic surfactant, and was a mobile liquid identified as G phase throughout the reaction. To prepare this blend by mixing a solution of the betaine with coconut diethanolamide would require a betaine concentration of 56% and at this concentration the material is a highly viscous gel, identified as $M_1$ phase.

EXAMPLE 8

A stirred Jacketed flask, equipped with a means of recycling material from the bottom to the top of the flask was charged with 400 g of 90% pure coconut diethanolamide. The material was heated to 60° C. and 305 g of a $C_{12}/_{14}$ alkyl dimethylamine (Molecular weight =221) was charged over 15 mins. A solution of 14ag chloracetic acid in 113 g water was added maintaining the pH at 8–8.5 by the addition of 47% sodium hydroxide. The temperature was increased to and the pH was maintained at 8–8.5 for a further 6 hrs., when no further sodium hydroxide was required to maintain a constant pH, indicating that quaternization was complete. In this preparation approximately 130 g 47% sodium hydroxide was required.

In this example a betaine was prepared in the presence of coconut diethanolamide, and the blend had a total surfactant concentration of 68% in a weight ratio of 2:1 of nonionic:amphoteric surfactant, and the mixture was a mobile liquid identified as G phase throughout the reaction. To prepare this blend by mixing a solution of the betaine with coconut diethanolamide would require a betaine concentration of 56%, and at this concentration the material is a highly viscous gel identified as $M_1$ phase.

EXAMPLE 9

A stirred jacketed flask equipped with a means for recycling material from the bottom to the top of the flask to assist mixing was charged with 189 g of 90% pure coconut diethanolamide, 115 g water, 1.2 g disodium ethane diamine tetra acetic acid, and 203 g of an 88% pure amine derived from an $C_{12/14}$ ethoxylated alcohol, having he formula

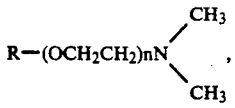

where the average value of n=3

The mixture of surfactant and surfactant precursor was heated to 55° C., and 82 g of a 27% solution of hydrogen peroxide was added at such a rate that the temperature was maintained in the range 60° C.–65° C. The reactants were then maintained at 65° C. for a further 12 hours. When the product was analyzed and found to contain 28% amine oxido.

In this example an amine oxide was prepared in the presence of coconut diethanolamide, and the blend had a total active of 62% in a weight ratio of 1.1:1 amine oxide to coconut diethanolamide.

The mixture formed a mobile G phase during the addition of hydrogen peroxide solution and remained in this phase throughout the reaction.

To prepare this blend by mixing a solution of the amine oxide with coconut diethanolamide would require an amine oxide concentration of 48%, and at this concentration the material is a highly viscous gel in the $m_1$ phase.

It would be possible to prepare this blend by mixing a 70% solution of the amine oxide with coconut diethanolamide, and then diluting to the required concentration, but this would be difficult, as the amine oxide only forms a mobile G phase over a very narrow concentration range.

EXAMPLE 10

A stirred jacketed flask, equipped with a means of recycling material from the bottom to the top of the flask, was charged with 588 g of 90% pure lauric diethanolamide. The lauric diethanolamide was heated to 60° C., and 221 g of a $C_{12/14}$ alkyl dimethylamine having a molecular weight of 221 was added over a 10 min. period. A solution of 138 g chloracetic acid in 127 g water was added over ½ hour maintaining the pH in the range 7–8 by the addition of 47% NaOH solution.

The pH of the mixture was raised to 8.5, and the temperature was increased to 65° C., and the reaction was maintained under these conditions for a further 9 hrs., when no further sodium hydroxide solution was required to maintain a constant pH, indicating that quaternization was substantially complete. On analysis the blend was found to contain 0.1% unreacted amine. Approximately 153 g of 47% sodium hydroxide solution was required in this preparation.

In this example a betaine was prepared in the presence of lauric diethanolamide, and the blend had a total surfactant concentration of 66% in a weight ratio of 1:2 amphoteric:nonionic surfactant and was a mobile liquid identified as G phase throughout the reaction.

To prepare this blend by mixing a solution of the betaine with the lauric diethanolamide would require a betaine concentration of 44% and at this concentration the material is a highly viscous gel in the $M_1$ phase.

EXAMPLE 11

Stirred, jacketed flask equipped with a means of recycling material from the bottom to the top of the flask to assist mixing was charged with 156 g of a 90% solution of a $C_{12-14}$ alkyl benzyl ammonium chloride, 156 g of 90% pure coconut diethanolamide and 151 g of an 88% pure amine derived from $C_{12-14}$ ethoxylated alcohol having the formula

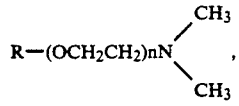

where the average value of n=3 together with 81.5 g water and 1.2 g EDTA. The mixture of surfactants and precursor was heated to 60° C. and 56 g of 27% solution of $H_2O_2$ was added over a 1 hour period. The reaction temperature was raised to 65° C. After 12 hours reaction the product was analyzed and found to contain 2.4% unreacted amine indicating a conversion of amine to amine oxide 90%.

In this example an amine oxide was prepared in the presence of a cationic and a non-ionic surfactant to give a total surfactant concentration of 67% in a 1_1_1 ratio of nonionic:cationic:nonionic surfactants.

The product was a mobile G phase throughout the reaction.

To prepare this blend by mixing a solution of the betaine with the lauric diethanolamide would require a betaine concentration of 44% and at this concentration the material is a highly viscous gel in the $M_1$ phase.

EXAMPLES 12–15

In all these examples a recycle neutralization loop of 205 mls total capacity was employed for the preparations, comprising a continuous loop incorporating a circulation pump operating at 2.2 liters per minute, a heat exchanger, a product overflow, and a mixer into which were separately fed the second surfactant and the precursors of the first surfactant. The product was sampled when material representative of these feeds was overflowing from the neutralization loop. (Throughout all percentages quoted are on a weight:weight basis.)

The following materials are referred to in these examples:

NC: This is a mixture of straight chain primary alcohols predominant $C_{12}$ and $C_{14}$, having a mean molecular weight of 194.

LX28: This is an aqueous L1 phase of the sodium salt of sulphated NC at 29% concentration of active matter, containing 0.7% free fatty matter and 0.7% sodium sulphate.

KB2: This is a two mole ethoxylate of NC.

ESB70: This is the G phase aqueous sodium salt of sulphated KB2 at 68% active matter, containing 2% nonionics and 1% sodium sulphate.

CDE: This is a diethanolamide of coconut fatty acid at about 90% concentration, the remainder being free amine free ester and glycerol impurities.

DDB sulphonic acid: This is based on a straight chain alkylbenzene having a mean molecular weight of 246. The sulphonic acid is at about 96% concentration containing nonionic, sulphuric acid and water impurities.

KSN70: This is an aqueous G phase sodium salt of a sulphated three mole ethoxylate of a mixture of straight chain primary alcohols, predominant $C_{12}$, $C_{14}$, $C_{16}$ an $C_{18}$ and having a mean molecular weight of 206. It is at 70% active matter, containing 2% nonionics and 1% sodium sulphate NP9: This is a nine mole ethoxylate of nonyl phenol.

EXAMPLE 12

Into the neutralization loop, initially full of ESB70, were fed ESB70 (8.67 g/min.), NC acid sulphate (10.0 g/min.), and a 31.5% aqueous solution of sodium hydroxide (4.82 g/min). A pH of 7.5±0.5 was maintained by small adjustments to the sodium hydroxide feed and the temperature was held at 44° C.

The product was a mobile 'G' phase at laboratory ambient temperature and analyzed as follows:

| | |
|---|---|
| Total active matter (at a calculated mean molecular wt. of 324.5) | 66.5% |
| Nonionics | 4.9% |
| Sodium sulphate | 2.4% |

(By calculation the components of the total active matter are in the ratio of 61.4.:38.6, LX:ESB).

On dilution with water the product passed into the M1 (gel) phase at 60% total active matter.

If it were attempted to manufacture this product by blending of the individual components, G phase ESB could be used but the physical form of the LX would present problems. ESB exists as mobile G phase from 62% to 72% active and thus LX at 69.6% to 63.5% active would be required. LX at these concentrations is a solid at temperatures below about 80° C. presenting manufacture and handling problems (sodium alkyl sulphates hydrolyze quite rapidly at these temperatures).

EXAMPLE 13

Into the neutralization loop, initially full of ESB70, were fed LX28 (6.67 g/min), KB2 acid sulphate (10.0 g/hr), and a 48.0% aqueous solution of sodium hydroxide (2.23 g/min). A pH of 7.5±0.5 was maintained by small adjustments to the sodium hydroxide feed and the temperature was held at 45° C.

The product was a mobile 'G' phase at laboratory ambient temperatures and analyzed as follows:

| | |
|---|---|
| Total active matter (at a calculated mean molecular weight of 367) | 65.0% |
| Nonionics | 1.9% |
| Sodium sulphate | 0.4% |

(by calculation the components of the total active matter are in the ratio of 15.8:84.2, LX:ESB.)

On dilution with water the product passed into the M1 phase at 62% active matter.

To produce this product by blending would involve similar problems to the previous examples. With the 62 or 72% active concentration limitation for ESB, LX at 87.8 to 42.8% active concentration would be required. LX at 42.8% active is a viscous paste which is difficult to pump at temperatures below the level at which hydrolysis is a problem (60° C.) while at 87.8% active the melting point of the material is in excess of 90° C. Between these concentrations temperatures of 60° C. to 90° C. are required for handling.

EXAMPLE 14

Into the neutralization loop, initially full of ESB70, were fed CDE (6.23 g/min), KB2 acid sulphate (5.83 g/min), and an 11.8% aqueous solution of sodium hydroxide (5.50 g/min). The pH was maintained at 7.5±0.5 by small adjustments of the sodium hydroxide feed and the temperature was held at 42° C.

The product was a mobile G phase at laboratory ambient temperatures and analyzed as follows:

| | |
|---|---|
| Anionic active matter (M.M. Wt, = 384) | 34.0% |
| Nonionics | 36.5% |
| Sodium sulphate | 0.3% |

(By calculation the determined nonionics level is composed of 32.0% CDE active, 3.6% nonionic impurities from the CDE, and 0.9% impurities from the KB2 acid sulphate.)

On dilution this material passed through a viscosity peak at 18% anionic active, at which the product was animmobile mixture of L1, M1 and G phases.

EXAMPLE 15

Into the neutralization loop, initially full of KSN70, were fed KSN70 (7.33 g/min), DDB sulphonic acid (4.64 g/min), and a 29.6% aqueous sodium hydroxide solution (2.05 g/min). The pH was maintained at 7.5±0.5 by small adjustments to the sodium hydroxide feed and the temperature was held at 40° C.

The product was a mobile G phase at laboratory ambient temperatures and analyzed as follows:

| | |
|---|---|
| Sulphonate active matter MMW = 348) | 34.0% |
| Sulphate active matter (MMW = 440) | 36.7% |
| Nonionics | 1.9% |
| Sodium sulphate | 1.4% |

On dilution with water the material formed M1 phase at 55% total active matter.

KSN exists as a mobile G phase at 65% to 74% active matter, and thus preparation of the above product by blending would require the use of 77.8 to 67.3 active sodium DDB sulphonate. At these concentrations sodium DDB sulphonate is a very viscous paste which tends to separate into two phases presenting handling difficulties.

Cosulph(on)ation of the mixed feedstocks would give inferior quality products from impurity and color viewpoints because of the differing reaction rates of the two materials towards sulphur trioxide.

EXAMPLE 16

Into the neutralization loop, initially full of the product of Example 15, was fed NP9 (8.75 g/min), DDB sulphonic acid (6.35 g/min), and a 17.9% aqueous sodium hydroxide solution (4.61 g/min). The pH was maintained at 7.5±0.5 by small adjustments to the sodium hydroxide feed and the temperature was held at 40° C.

The product was a mobile 'G' phase at laboratory ambient temperatures and analyzed as follows:

| | |
|---|---|
| Anionic active matter (MMW = 348) | 33.1% |
| Nonionics | 45.1% |
| Sodium sulphate | 0.7% |

(By calculation the determined nonionics level includes 44.4% NP9).

On dilution with water there was a continual reduction in viscosity down to L1 phase formation.

If the product of this example were made by blending using the liquid NP9, sodium DDB sulphonate of 59.5% active matter would be required. At this concentration sodium DDB sulphonate is a paste which tends to separate into two phases, and thus blending is a more troublesome operation than the direct manufacturing route.

It will be understood that references herein to liquid precursors relate to the state at the reaction temperature, and that the term includes some precursors that are solid at ambient temperatures.

It also includes precursors that are present in the reaction mixture as the dispersed phase of an emulsion.

What is claimed is:

1. A method for the manufacture of a concentrated aqueous surface active composition, comprising as the active constituent an active mixture of at least two non-homologous surfactants, each in a proportion of at least 5% by weight of the active mixture, which composition is capable of forming a fluid "G" phase, wherein at least one of the surfactants is capable of being formed by a reaction in an aqueous solution from a precursor which is liquid under the conditions of the reaction by a reagent which does not cause substantial degradation of any other surfactant in the mixture, and wherein the composition is formed by converting at least one of the precursors into the corresponding surfactant in the presence of at least one other surfactant component of the mixture and in the presence of sufficient water to maintain the reaction mixture in a fluid state and provide a final composition which is at least predominantly in the "G" phase, wherein the precursor is a non-quaternary amine or nitrogen containing heterocyclic compound, and the other surfactant or surfactants are cationic, nonionic and/or amphoteric surfactants and the composition is formed by converting the precursor into a cationic surfactant with a quaternizing agent or acid.

2. The method according to claim 1, wherein said final composition which is at least predominantly in the "G" phase comprises more than above 60% of said active constituent.

3. The method according to claim 2, wherein said concentrated aqueous surface active composition consists essentially of as the active constituent a mixture of said at least two non-homologous surfactants, each in a proportion of at least 5% by weight of the active mixture.

4. The method according to claim 1, wherein said concentrated aqueous surface active composition consists essentially of as the active constituent a mixture of said at least two non-homologous surfactants, each in a proportion of at least 5% by weight of the active mixture.

5. A method for the manufacture of a concentrated aqueous surface active composition, comprising as the active constituent an active mixture of at least two non-homologous surfactants, each in a proportion of at least 5% by weight of the active mixture, which composition is capable of forming a fluid "G" phase, wherein at least one of the surfactants is capable of being formed by a reaction in an aqueous solution from a precursor which is liquid under the conditions of the reaction by a reagent which does not cause substantial degradation of any other surfactant in the mixture, and wherein the composition is formed by converting at least one of the precursors into the corresponding surfactant in the presence of at least one other surfactant component of the mixture and in the presence of sufficient water to maintain the reaction mixture in a fluid state and provide a final composition which is at least predominantly in the "G" phase, wherein the precursor is a non-quaternary amine or nitrogen containing heterocyclic compound, and the other surfactant or surfactants are either cationic surfactants or anionic surfactants or amphoteric surfactants or nonionic surfactants or mixtures of anionic surfactants with nonionic and/or amphoteric surfactants, and the composition is formed by converting the precursor into an amphoteric surfactant.

6. The method according to claim 5, wherein the surfactant is converted into an amphoteric surfactant by reaction with chloracetic acid.

7. The method according to claim 6, wherein said concentrated aqueous surface active composition consists essentially of as the active constituent a mixture of said at least two non-homologous surfactants, each in a proportion of at least 5% by weight of the active mixture.

8. The method according to claim 5, wherein said concentrated aqueous surface active composition consists essentially of as the active constituent a mixture of said at least two non-homologous surfactants, each in a proportion of at least 5% by weight of the active mixture.

9. The method according to claim 5, wherein said final composition which is at least predominantly in the "G" phase comprises more than 60% of said active constituent.

10. The method according to claim 9, wherein said concentrated aqueous surface active composition consists essentially of as the active constituent a mixture of said at least two non-homologous surfactants, each in a proportion of at least 5% by weight of the active mixture.

11. A method for the manufacture of a concentrated aqueous surface active composition, comprising as the active constituent an active mixture of at least two non-homologous surfactants, each in a proportion of at least 5% by weight of the active mixture, which composition is capable of forming a fluid "G" phase, wherein at least one of the surfactants is capable of being formed by a reaction in an aqueous solution from a precursor which is liquid under the conditions of the reaction by a reagent which does not cause substantial degradation of any other surfactant in the mixture, and wherein the composition is formed by converting at least one of the precursors into the corresponding surfactant in the presence of at least one other surfactant component of the mixture and in the presence of sufficient water to maintain the reaction mixture in a fluid state and provide a final composition which is at least predominantly in the "G" phase, which comprises mixing a liquid nonionic surfactants with an amine precursor and quaternizing the precursor with aqueous chloracetic acid.

12. The method according to claim 11, wherein said concentrated aqueous surface active composition consists essentially of as the active constituent a mixture of said at least two non-homologous surfactants, each in a proportion of at least 5% by weight of the active mixture.

13. The method according to claim 11, wherein said final composition which is at least predominantly in the "G" phase comprises more than 60% of said active constituent.

14. The method according to claim 13, wherein said concentrated aqueous surface active composition consists essentially of as the active constituent a mixture of said at least two non-homologous surfactants, each in a proportion of at least 5% by weight of the active mixture.

* * * * *